US009878532B2

(12) United States Patent
Zhang et al.

(10) Patent No.: US 9,878,532 B2
(45) Date of Patent: Jan. 30, 2018

(54) IMAGING DEVICE HAVING FLUID CONTAINER

(71) Applicant: Hewlett-Packard Development Company, L.P., Fort Collins, CO (US)

(72) Inventors: Daihua Zhang, Palo Alto, CA (US); Napoleon J. Leoni, Palo Alto, CA (US); Henryk Birecki, Palo Alto, CA (US); Omer Gila, Palo Alto, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 18 days.

(21) Appl. No.: 14/988,567

(22) Filed: Jan. 5, 2016

(65) Prior Publication Data

US 2016/0159081 A1 Jun. 9, 2016

Related U.S. Application Data

(62) Division of application No. 13/153,029, filed on Jun. 3, 2011, now Pat. No. 9,248,639.

(51) Int. Cl.

| | |
|---|---|
| ***G03G 15/10*** | (2006.01) |
| ***B41F 31/13*** | (2006.01) |
| ***G03G 21/00*** | (2006.01) |
| ***G03G 15/11*** | (2006.01) |
| ***B41F 31/02*** | (2006.01) |
| *G03G 21/10* | (2006.01) |

(52) U.S. Cl.

CPC ..... *B41F 31/13* (2013.01); *B41F 31/027* (2013.01); *G03G 15/11* (2013.01); *G03G 21/0088* (2013.01); *G03G 21/10* (2013.01)

(58) Field of Classification Search

CPC ..... B41F 31/02; B41F 31/04; B41F 31/06; B41F 31/07; G03G 15/10; G03G 15/11; G03G 21/0088; G03G 21/10

USPC ... 101/363, 364, 350.5, 350.6, 489, DIG. 37

See application file for complete search history.

(56) References Cited

U.S. PATENT DOCUMENTS

| | | | | |
|---|---|---|---|---|
| 3,661,079 A | | 5/1972 | Stapleford | |
| 4,041,864 A | | 8/1977 | Dahlgren et al. | |
| 4,270,450 A | | 6/1981 | Difflipp et al. | |
| 4,581,995 A | * | 4/1986 | Stone | B41F 31/027 101/366 |
| 4,782,756 A | | 11/1988 | Howard | |
| 5,058,502 A | * | 10/1991 | Kobler | B41F 31/027 101/363 |
| 5,103,732 A | * | 4/1992 | Wells | B41F 31/027 101/148 |
| 5,213,037 A | * | 5/1993 | Leopardi, II | B41F 5/24 101/363 |
| 5,410,961 A | | 5/1995 | DeNicola et al. | |
| 5,651,316 A | | 7/1997 | DeMoore et al. | |
| 5,983,797 A | | 11/1999 | Secor | |
| 6,116,158 A | | 9/2000 | DeMoore et al. | |

(Continued)

FOREIGN PATENT DOCUMENTS

WO WO 2010127913 A1 * 11/2010 ..... B41F 23/08

*Primary Examiner* — Leslie J Evanisko

(74) *Attorney, Agent, or Firm* — Thorpe, North & Western L.L.P.

(57) ABSTRACT

An imaging device can include an imaging drum to support a carrier fluid. A roller can remove a portion of the carrier fluid from the imaging drum. A fluid container can collect the carrier fluid from the roller. A fluid remover on the container can be used to remove the carrier fluid from the roller.

9 Claims, 13 Drawing Sheets

(56) References Cited

U.S. PATENT DOCUMENTS

| | | | | |
|---|---|---|---|---|
| 6,314,881 | B1 * | 11/2001 | Gotting | B41F 13/21 101/216 |
| 6,557,465 | B2 * | 5/2003 | Baum | B41F 31/027 101/174 |
| 6,615,004 | B1 | 9/2003 | Gila et al. | |
| 7,487,724 | B1 * | 2/2009 | Evans | B41F 31/06 101/350.1 |
| 7,497,160 | B2 | 3/2009 | Kumagai | |
| 7,650,850 | B2 | 1/2010 | Iwasaki et al. | |
| 7,760,217 | B1 | 7/2010 | Fotland et al. | |
| 7,896,966 | B2 | 3/2011 | Masuyama et al. | |
| 2005/0201785 | A1 | 9/2005 | Gila et al. | |
| 2006/0029430 | A1 | 2/2006 | Hosoya et al. | |
| 2010/0258015 | A1 | 10/2010 | Boettcher | |
| 2010/0284709 | A1 | 11/2010 | Izawa et al. | |
| 2011/0100242 | A1 * | 5/2011 | Krueger | B41F 31/04 101/365 |
| 2012/0118183 | A1 * | 5/2012 | Masuch | B41F 23/08 101/217 |

* cited by examiner

IMAGING DEVICE HAVING FLUID CONTAINER

The present application is a divisional of U.S. patent application Ser. No. 13/153,029, filed on Jun. 3, 2011, now patented as U.S. Pat. No. 9,248,639 issued on Feb. 2, 2016, which is incorporated herein by reference in its entirety.

BACKGROUND

Imaging devices and methods can be used for forming hard copy images upon media. An imaging method used in digital lithography can form an image using "electrical pinning," which can separate a carrier liquid from ink solids. An example imaging method using "electrical pinning" can include applying a marking agent on an imaging drum and selectively charging a marking agent layer with a charge emitting head based on the desired image. A developing fluid may be applied to the imaging drum to develop the charged image and a first removal device may remove the development fluid after the charged marking agent is developed. Additional charge may be applied to the developed marking agent with a blanket electrical charge which can stiffen the image and increase the resistance of a developed image to shear stresses during subsequent processes such as drying or image transfer. During processing prior to transfer to paper or other substrate, additional development fluid may be removed from the imaging drum using a second removal device, such as a vacuum head, suction device, or a heater device to evaporate the development fluid. A transfer assembly can directly transfer the stiffening marking agent corresponding to the developed image to a media (e.g., paper, plastic, etc.).

DETAILED DESCRIPTION

Figure 1:
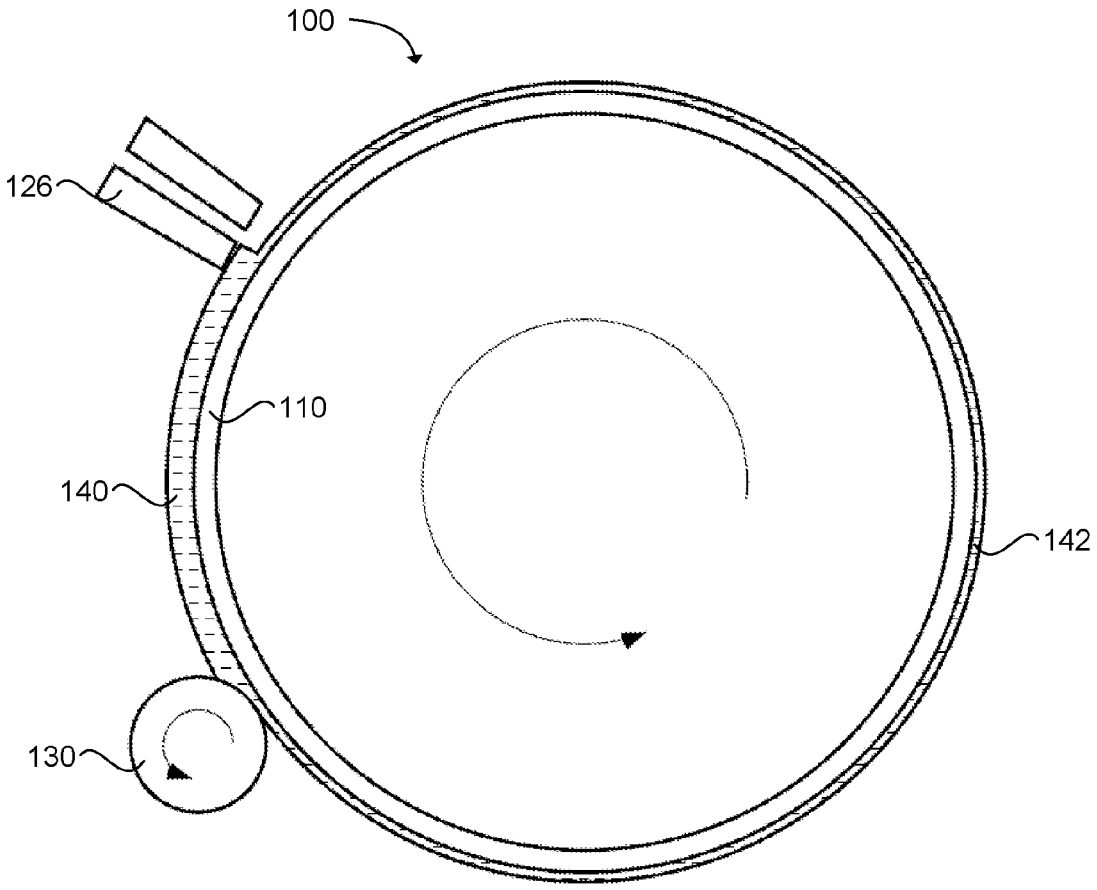
FIG. 1 is an illustrative diagram of an imaging device with a reverse roller and an imaging drum in accordance with an example.

Alterations and further modifications of the illustrated features, and additional applications of the principles of the examples, which would occur to one skilled in the relevant art and having possession of this disclosure, are to be considered within the scope of the disclosure. The same reference numerals in different drawings represent the same element.

In a method for forming an image, a roller can be used to apply a marking agent in a carrier fluid or remove the carrier fluid. In another example, a roller can be used to apply and/or remove a carrier fluid with a development agent (development fluid). In an example imaging method, an image can be formed using "electrical pinning," which can separate a carrier liquid from ink solids in a marking agent. The separation of the liquid from the solid can allow the carrier liquid to be extracted through mechanical approaches, such as a reverse roller, a squeegee, or a blade. Mechanical separation can reduce the time for thermal evaporation or eliminate an evaporation mechanism, such as a vacuum or infrared (IR) heater. Mechanical approaches can be referred to as "cold" processes and can consume significantly less energy than evaporation and eliminate environmental issues associated with volatile carriers.

The roller used to remove a carrier fluid from an imaging drum can be referred to as a removal roller. An application roller can be used to apply a carrier fluid. The application roller can use a similar mechanism as a removal roller assembly. The application roller can be either a reverse roller or forward roller. The removal roller can be either a reverse roller or forward roller. The forward roller can use a similar mechanism as a reverse roller but with a rotation of the roller opposite that of the reverse roller. The roller used in the imaging device described may be a forward/reverse roller, which can be determined by the rotation of the roller.

For example in an imaging device 100, a reverse roller 130 may be rotatably coupled to an imaging drum 110, as illustrated by FIG. 1. In another example (not shown), a forward or reverse roller may be coupled to an imaging belt or other rotating imaging mechanism. Referring back to FIG. 1, a fluid applicator 126 may apply a carrier fluid 140 onto a fixed location relative to an axis of the imaging drum. For example, the carrier fluid can be any fluid that can be supported by an imaging drum and the roller. The carrier fluid 140 and 142 can be an Isopar-L™ oil (an aliphatic hydrocarbon fluid available from ExxonMobil Corporation) or similar electrically insulating fluid for supporting a marking agent and/or being supported by a roller and imaging drum. The carrier fluid may include a marking agent. The marking agent can be a liquid ink or a solid colorant. Alternatively, the carrier fluid can include a development agent or a development fluid.

The reverse roller can remove a portion of the carrier fluid leaving a thinner and/or uniform fluid layer 142. The reverse roller can be efficient in fluid removal, which can produce a fluid layer thickness less than 3 μm. A reverse roller and the imaging drum can have the same rotation relative to each other, either both clockwise or both counterclockwise, so a surface of the imaging drum moves in opposite or reverse direction as a surface of the reverse roller. The reverse direction of the imaging drum surface and the reverse roller surface with respect to each other can create a mechanism to remove the carrier fluid.

Cold removal of ink carrier can use significantly less energy than thermal evaporation. The cold process allows most of the carrier fluid to be cycled without going through evaporation and/or re-condensation, significantly reducing the volatile organic compound (VOC) emission of a printing press using the imaging device. VOCs can refer to organic chemical compounds which can have significant vapor pressures and which can affect the environment and human health. Typical IR heaters can take several seconds to evaporate a thick fluid layer (such as 20 μm), while cold removal takes a shorter length of time (e.g., several milliseconds or less) to complete the same task.

Two types of cold removal approaches can include contact removal and non-contact removal. As their names imply, contact removal such as squeegee and blade can make physical contact with the latent image, whereas the non-contact approach, taking reverse roller (RR) as an example, can remove the carrier without touching the imaging surface. Non-contact removal can minimize the interference with the latent image and reduce the chance of ink back-transfer and dot smearing. As a result, using a non-contact removal can have some advantages over contact removal.

Figure 2:
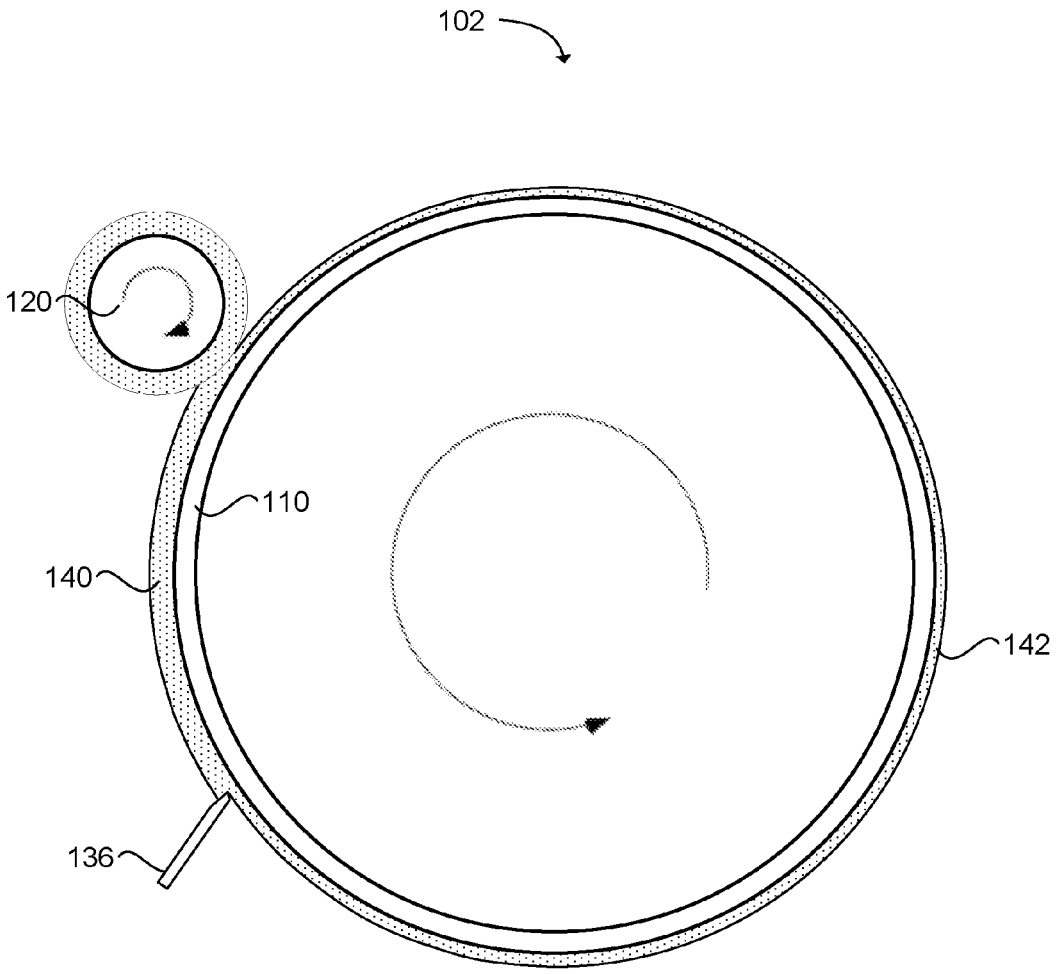
FIG. 2 is an illustrative diagram of an imaging device with a forward roller and an imaging drum in accordance with an example.

In another example illustrated by FIG. 2, an imaging device 102 can use a forward roller 120 to apply the carrier fluid 140 to an imaging drum 110 onto a fixed location relative to an axis of the imaging drum. The applied carrier fluid can create a fluid layer. A forward roller and the imaging drum can have opposite rotations relative to each other, one clockwise and the other counterclockwise, so a surface of the imaging drum and a surface of the forward roller moves in the same direction. The forward direction of the imaging drum surface with respect to the forward roller surface can create a mechanism to apply the carrier fluid with the agents embedded in the carrier fluid. A blade or squeegee 136 can be used to remove a portion of the carrier fluid leaving a thinner fluid layer 142.

Figure 3:
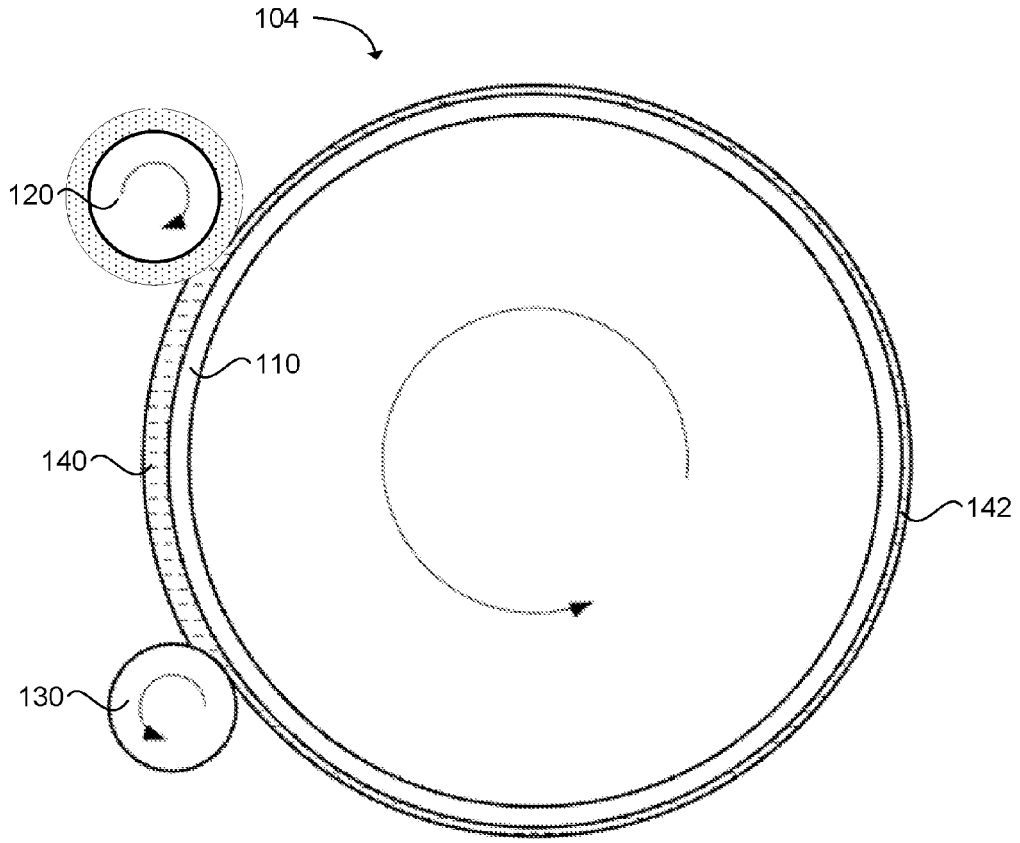
FIG. 3 is an illustrative diagram of an imaging device with a forward roller, a reverse roller, and an imaging drum in accordance with an example.

The reverse roller may be paired with a fluid applicator that provides fluid to couple the reverse roller with the wet latent image. In one example, the fluid applicator can use a forward roller (FR) 120, which can leverage the same mechanical design of the reverse roller (RR) 130, as illustrated in FIG. 3. The imaging device 104 can couple the forward rotation rate of carrier fluid application by the forward roller with the reverse rotation rate of carrier fluid removal by the reverse roller. The forward roller can provide a uniform application thickness of the carrier fluid. The reverse roller can provide a uniform removed thickness of the carrier fluid.

Figure 4:
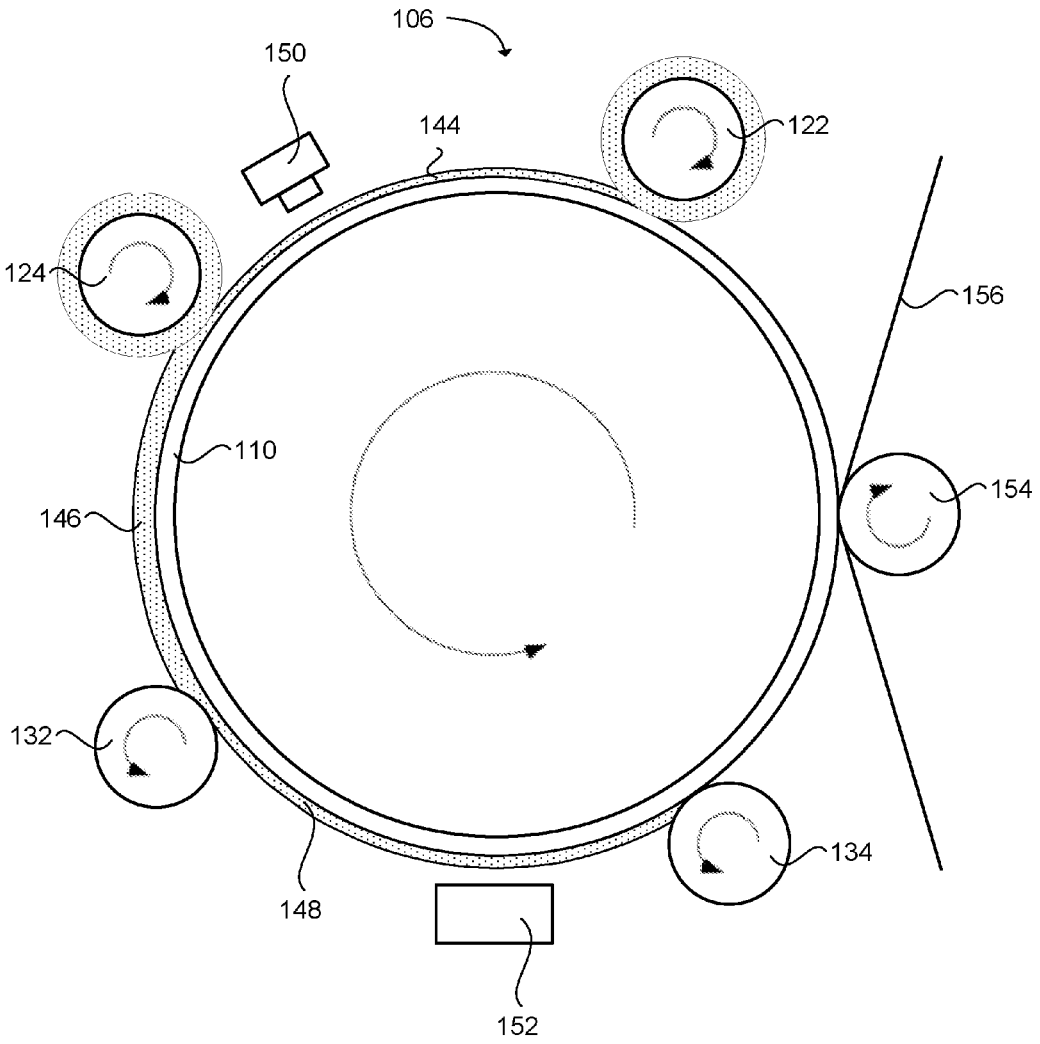
FIG. 4 is an illustrative diagram of an imaging device with an imaging drum and a plurality of forward rollers and reverse rollers in accordance with an example.

Another example illustrated by FIG. 4, an imaging device 106 can use an imaging drum 110, forward rollers, reverse rollers, and other components used in the imaging process. The imaging device can include an imaging drum, a marking agent supply device 122 using a carrier fluid, an image head 150, a development assembly including a development fluid applicator 124 and a development fluid removal device 132, a charge device 152, a removal device 134 of remaining carrier fluid, and a transfer assembly 154. Other configurations of the imaging device can include more, less, or alternative components in other arrangements.

The imaging drum 110 can have an imaging drum surface, where images may be formed and developed prior to being transferred to media (e.g., paper, plastic, etc.). The imaging drum may be electrically grounded and/or electrically conductive and include electrically conductive materials such as metal. A marking agent in a carrier fluid (e.g., liquid marking agent) may be applied in a layer to the imaging drum using a marking agent supply device 122. The marking agent supply device may include a forward roller. A marking agent layer 144 may include colorant particles suspended in an electrically insulative carrier fluid and the marking agent layer may have a solids concentration between 5% and 30%.

An image head 150 may electrically charge some portions of the layer of marking agent and leave other portions of the layer of marking agent unexposed. The control charge exposure operations of the image head can transfer an image pattern to be generated on the imaging drum. The electrically charged selected portions of the marking agent can define the images. The cohesion and adhesion to the imaging drum of the portions of the layer of the marking agent exposed to the electrical charge can be increased by the electrical charge compared with the portions not receiving the electrical charge. In other words, the exposed portions of the marking agent can be stiffened by the electrical charge.

A development assembly including a development fluid applicator 124 and a development fluid removal device 132 can be located adjacent to the surface of the imaging drum. In one example, following the exposure of the portions of the marking agent layer corresponding to an image to be formed, the unexposed portions of the marking agent corresponding to the background areas may be removed (washed away) from the imaging drum surface during development by the development assembly. The development fluid can be used to develop images in marking agent layer after the image has been exposed by the image head 150. The development fluid applicator may apply the development fluid using a forward roller to the imaging drum having the exposed and unexposed portions of marking agent thereon. The development fluid can be combined with the marking agent in the carrier fluid carrier forming a carrier and development fluid layer 146. The development fluid can operate to help detach and flush away the unexposed portions of the marking agent from the imaging drum surface leaving the exposed portions of the marking agent corresponding to the image to be formed upon imaging drum surface. The development fluid can develop the image by cleaning the marking agent from the uncharged areas of the imaging drum surface not corresponding to the latent image. The development fluid removal device may remove the development fluid and/or carrier fluid from the imaging drum using a reverse roller.

In one example discussed below, an additional removal device 134 may be implemented to remove development fluid remaining upon the imaging drum surface after development by the development assembly. A charge device 152 may be placed adjacent to the imaging drum surface to provide an additional electrical charge to the developed portions of the marking agent over the imaging drum surface. The charge device can provide an electrical charge for an axial length of the imaging drum including both developed marking agent and background image areas. The provision of the additional electrical charge may maintain image quality during subsequent imaging operations.

As discussed previously, the marking agent in the carrier fluid on the imaging drum can be exposed to two electrical charge devices. An initial attraction force (e.g., electrostatic force) may be provided between the exposed portions of the marking agent and the imaging drum surface after exposure by image head 150. The initial attraction force attracts the exposed portions to the imaging drum surface. The application of the electrical charge by the charge device 152 can operate to increase the attraction force between the exposed portions of the marking agent (i.e., corresponding to the developed portions after development by development assembly). The charge provided by the charge device can operate to clamp the developed image to the imaging drum surface which can enable the utilization of the subsequent imaging operations described below without significant image degradation, such as distortion or smearing. The increased charge density provided by the charge device can increase the resistance of a developed image to shear stresses during subsequent processing such as drying or image transfer. In one example, the electrical charge provided by the charge device can increase the image stiffness (i.e., increases the viscosity if a liquid marking agent is used) and can increase the shear strength of a developed image.

Following charging by the charge device 152, the developed portions of the marking agent corresponding to the developed image can be processed by an optional removal device 134, as previously discussed. The removal device can remove additional development fluid and/or carrier from the imaging drum surface depending on the development fluid and/or carrier removed by development fluid removal device 132 and a remaining fluid layer 148 left on the imaging drum surface. The removal device can include a reverse roller and/or a dryer, which may create a flow of air over the imaging drum surface to remove remaining development fluid from the imaging drum surface which may otherwise degrade the resultant image generated by imaging device 106 if left upon the imaging drum surface. Examples of the removal device can include an air knife to provide the flow of air, a vacuum head or other suction device configured to remove the development fluid, a heater to evaporate the development fluid upon the imaging drum surface, and/or as a reverse roller to shear away excess development fluid. A transfer assembly 154 can be used to directly transfer the stiffened marking agent corresponding to the developed image from the imaging drum surface to a media 156.

Figure 5:
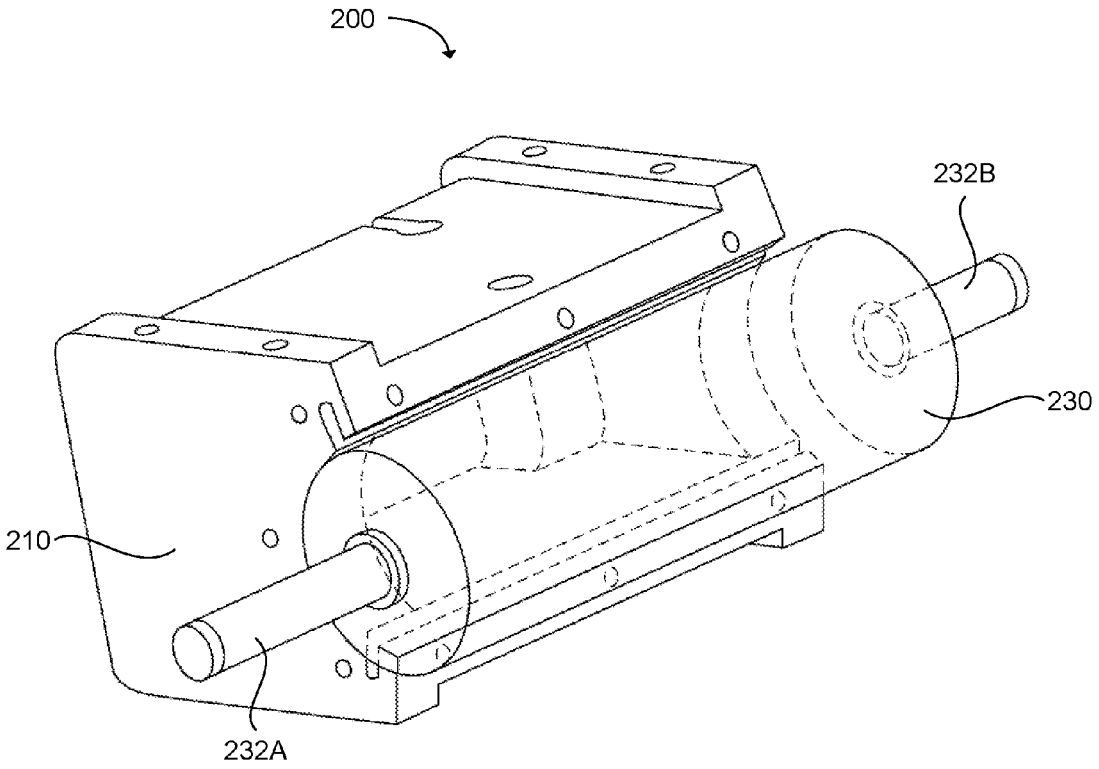
FIG. 5 is an illustrative diagram of a roller with a fluid container in accordance with an example.

In an example, a forward roller and/or reverse roller unit 200 of the imaging device may include a roller 230 coupled to a fluid container 210, as illustrated in FIG. 5. The container can include a cavity or void, which can act as a fluid reservoir to collect a carrier fluid from a roller or dispense a carrier fluid to a roller. When the roller is operating as an application roller, the fluid container can replenish the carrier fluid used by the roller. When the roller is operating as a removal roller, the fluid container can collect the carrier fluid removed by the roller. The carrier fluid can include a marking agent (a marking agent fluid) or a development agent (a development fluid). The container can conform to the shape of a roller to contain the fluid. The illustrated container of FIG. 5 has a cuboid shape (hexahedron) with one open face, but other shapes and configurations can also be used as long as the container shape conforms to the roller. The container may be formed of a plastic material, a metal material, or combination of these materials. The roller may revolve around an axis and be supported by a roller shaft (axle or pins) 232A and 232B. The roller may be fabricated with a metal or conductive material to collect a carrier fluid accumulated on a roller surface.

The forward/reverse roller unit can provide cold application/removal of a carrier fluid used in imaging or printing. Using a fluid container offers controllability, reliability and flexibility in using a roller. The roller can provide efficient fluid removal producing a thin (less than 3 μm) and uniform fluid layer, and the container can allow the operation of the roller over a wide range of angles (allowing the roller unit more or less gravity independent) and a no drip operation (beneficial for image quality).

Figure 6:
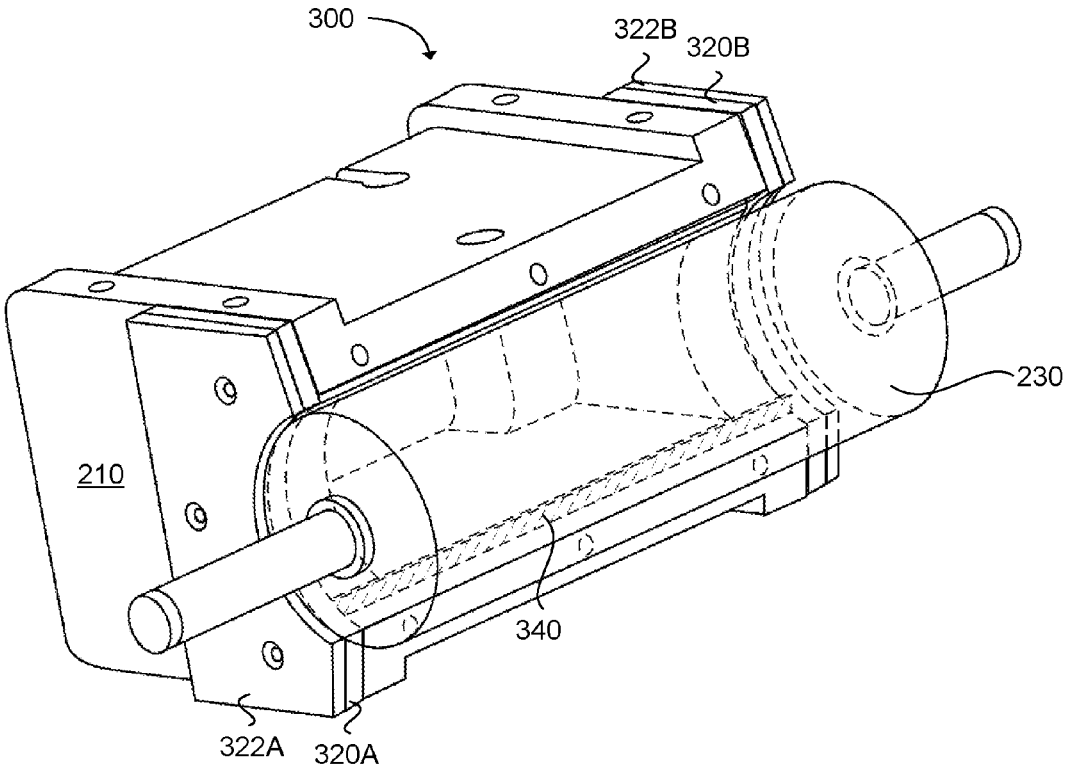
FIG. 6 is an illustrative diagram of a roller with a fluid container, a blade, and fluid seals in accordance with an example.

As illustrated in FIG. 6, the forward roller and/or reverse roller unit 300 can include the fluid container 210 with a fluid remover 340 on the fluid container for removing the carrier fluid from the roller. In the example illustrated in FIG. 6, the fluid remover is a blade for scraping the carrier fluid from the roller. The blade may be a doctor blade. The blade may be formed from polymeric material, metal material, or combination of these materials. The blade can make contact with the roller. The blade can be any device or knife used to scrape carrier fluid from a roller. The blade may be installed on one or more an edges of the fluid container. The blade can seal the carrier fluid in the container. The blade can scrape returning fluid off from the roller surface when the roller is operating as a reverse roller and can scrape off excess carrier fluid from the roller surface when the roller is operating as a forward roller. The blade may be coupled to the fluid container with an adhesive, rivets, screws, bolts, or other fastener.

The fluid container can include fluid seal mounts 322A and 322B for sealing the fluid container 210 against the roller 230 and sealing the carrier fluid in the fluid container. The fluid seals may be attached or integrated on each end of the fluid container. A first seal 320A may be attached or integrated on a first side, face, or edge of the fluid container and a second fluid seal 320B may be attached or integrated on a second side, face, or edge of the fluid container opposite from the first fluid seal. The first fluid seal and the second fluid seal can conform to the curvature of the roller. The seal material for the first fluid seal and the second fluid seal can be selected to minimize friction at the interface with the roller. Closed-cell foams can be used to seal the carrier fluid at the roller sides. Other material that can minimize friction and seal the carrier fluid may also be used. The first fluid seal and the second fluid seal can channel the carrier fluid on the roller between first fluid seal and the second fluid seal. The seals may be coupled to a fluid container with seal mounts. The seal mounts 322A and 322B can provide rigid support for the fluid seals on the fluid container. The seal mounts may be formed of a plastic material, a metal material, or combination of these materials. The seal mounts may be coupled to the fluid container with rivets, screws, bolts, or other fastener. With the blade 340 and the seal mounts 320A and 320B, the carrier fluid with the agents in the carrier fluid can be enclosed in the fluid reservoir of the fluid container leaving a small gap for fluid to pass in and out of the fluid reservoir.

Figure 7:
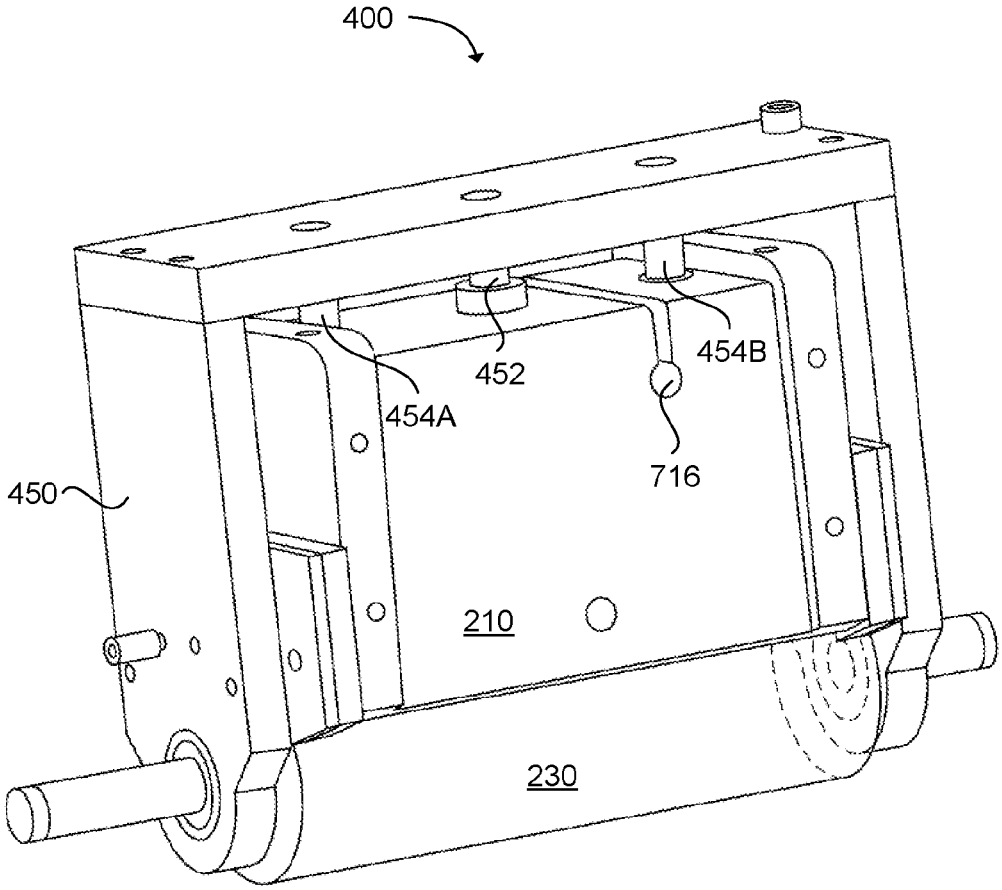
FIG. 7 is an illustrative diagram of a roller with a fluid container, a roller frame, guides, and a resilient member in accordance with an example.

The forward roller and/or reverse roller unit 400 can include the roller 230 rotatably coupled to a roller frame 450, as illustrated in FIG. 7. The roller frame and/or roller may include bearings for reducing the friction between the roller and the roller frame. The roller frame can couple the fluid container 210 to the roller. The roller frame and/or fluid container may include a guide 454A and 454B for guiding the fluid container against the roller in a specified manner. The guide may include a rail on the roller frame with a mating groove on the fluid container. Alternatively, the guide may include a protrusion on the fluid container with a corresponding groove on the roller frame. Motion of the fluid container can be guided by multiple rails A roller frame 450 can include a resilient member 452, such as a spring, for applying a force to press the fluid container 210 against the roller 230. The force applied by the resilient member on the fluid container against the roller can improve the seal provided by the blade and the fluid seals. The resilient member may include a spring or elastic mechanism to apply a force on the fluid container from a point on the roller frame. The resilient member can bias the fluid container, together with the curved seals and the blade onto a roller surface. In an example, the roller frame may allow for adjustable angles of the fluid container with respect to the roller.

Figure 8:
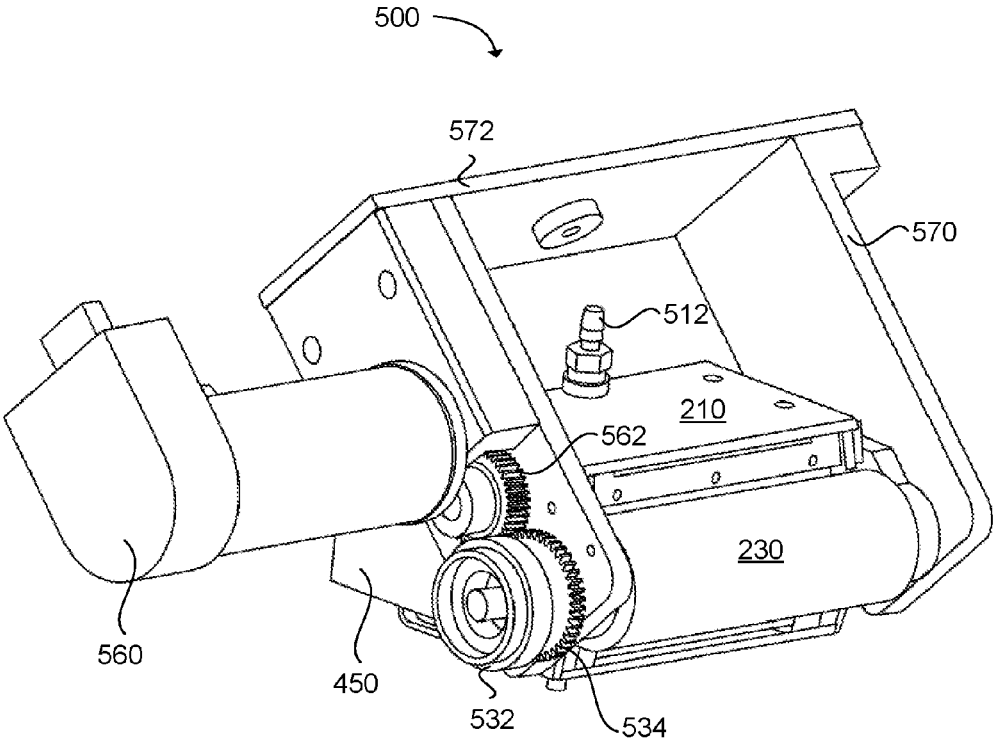
FIG. 8 is an illustrative diagram of a roller with a fluid container coupled to a motor with a motor frame in accordance with an example.

The forward roller and/or reverse roller unit 500 can include a motor frame 570 and 572 that can be built on the roller shaft to mount a motor and gears 534 and 562 to the roller 230, as illustrated in FIG. 8. The roller frame 450 can include the roller 230 and fluid container 210 coupled to a motor assembly 560. A motor frame can be used to couple the motor assembly to the roller frame. The motor assembly may include a motor for driving and rotating the roller. The motor may be rotatably coupled to a roller using gears 534 and 562. In another example (not shown), a belt or shaft may be used to couple the motor to the roller. The motor may be a variable speed motor that can be controlled by an imaging device processor. In an example, the motor frame may allow the roller frame to be placed at adjustable angles with respect to the imaging drum and/or motor frame. A roller surface can be spaced a predetermined distance from the imaging drum surface with a spacer wheel (e.g., a spacer roller or spacer ring). The roller can include the spacer wheel 532 for providing a predetermined distance between the imaging drum and the roller. The spacer wheel may be coupled to the roller and roll on the imaging drum when the roller is pressed against the imaging drum. In another example (not shown), the spacer wheel may be integrated or coupled to the imaging drum, so a space is created between the roller and imaging drum when the spacer wheel is pressed against the imaging drum. The spacer wheel may be removable so spacers of various diameters may be used to change the spacing between the roller and imaging drum.

Figure 9:
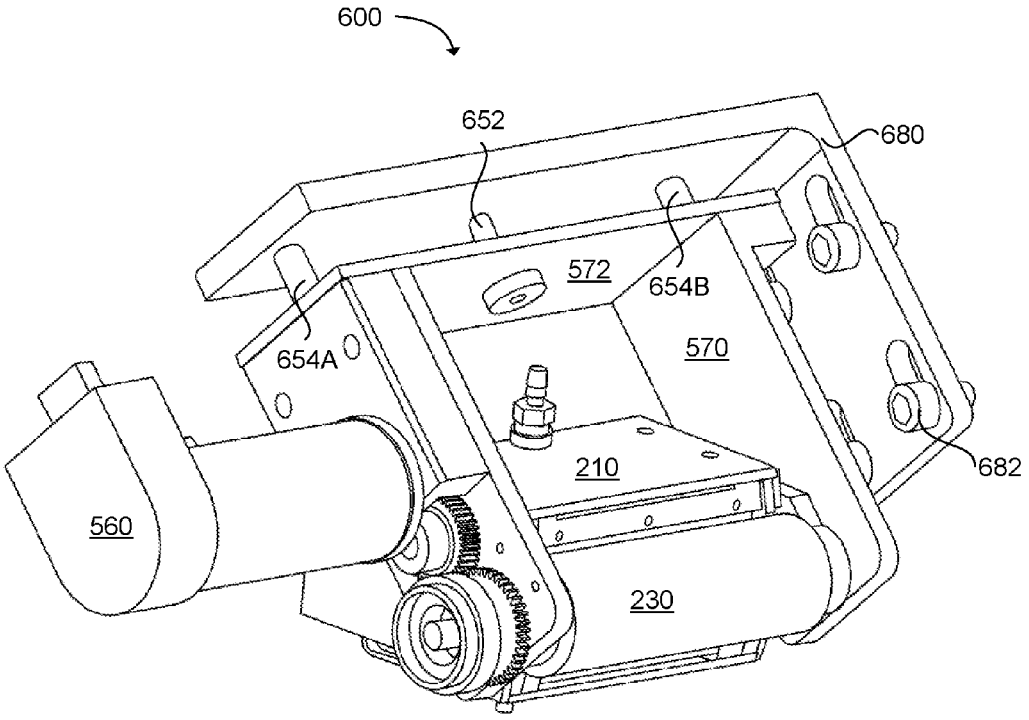
FIG. 9 is an illustrative diagram of a roller with a fluid container coupled to a motor with a motor frame coupled to an image drum mount in accordance with an example.

The forward roller and/or reverse roller unit 600 can include the motor frame 570 and 572 that can be coupled to an image drum mount 680, as illustrated in FIG. 9. The image drum mount can provide a coupling of the motor frame assembly and the roller assembly to an image drum assembly. Another set of resilient members and guides to engage the whole roller toward the imaging surface on the imaging drum can be used to allow the spacer wheels to set the gap at the imaging surface (not shown). A motor frame resilient member 652, such as a spring, can apply a force to press the motor frame against the imaging drum (not shown). The motor frame and/or image drum mount may include a motor frame guide 654A and 654B for guiding the forward roller and/or reverse roller unit against the imaging drum in a specified manner. The gap at the roller nip can be determined by the radius difference between the spacer wheel and the roller. The roller nip gap may be the smallest distance between the roller surface and imaging drum surface. The orientation of the motor frame and the fluid container (or fluid collector) can be adjusted independently, allowing the forward roller and/or reverse roller unit to work at different angles. The image drum mount can couple the forward roller and/or reverse roller unit to the imaging drum using welds, adhesives, rivets, screws, bolts 682, or other fasteners.

Referring back to FIG. 4, the fluids delivered by forward rollers and collected by reverse rollers used in an imaging device can be managed and controlled. A fluid cycling system can be used to drive the fluid to the forward roller and/or reverse roller units of the imaging device. The fluid flow can be designed to reduce or eliminate any leaking or overflow that can interfere with other stations in the imaging device and ruin the final print. The FR/RR units may allow good mounting flexibility to operate at different angular positions. Some benefits for allowing for different angular positions can be that the fluid addition and/or removal may be needed in multiple places around the imaging surface, and several marking stations such as inkjet heads and priming unit may have certain fixed angles, leaving few mounting options for the rest units.

To allow for the positioning of the forward roller and/or reverse roller units at a wide array of angular positions the FR/RR units may be drip free (or reducing drips) as any leak may potentially fall on the image, which may cause unacceptable image degradation. The roller with a relatively small, closed fluid container can eliminate fluid overflow and dripping, which will be discussed further below. The roller unit may be able to collect excessive fluid removed from the imaging surface and guide the fluid back to a reservoir in confined channels. The roller with a closed fluid container can enabled improved control over fluid dispensing speed and coating uniformity and improves mounting flexibility of the roller unit to make the roller unit compatible with multiple angular positions.

Figure 10:
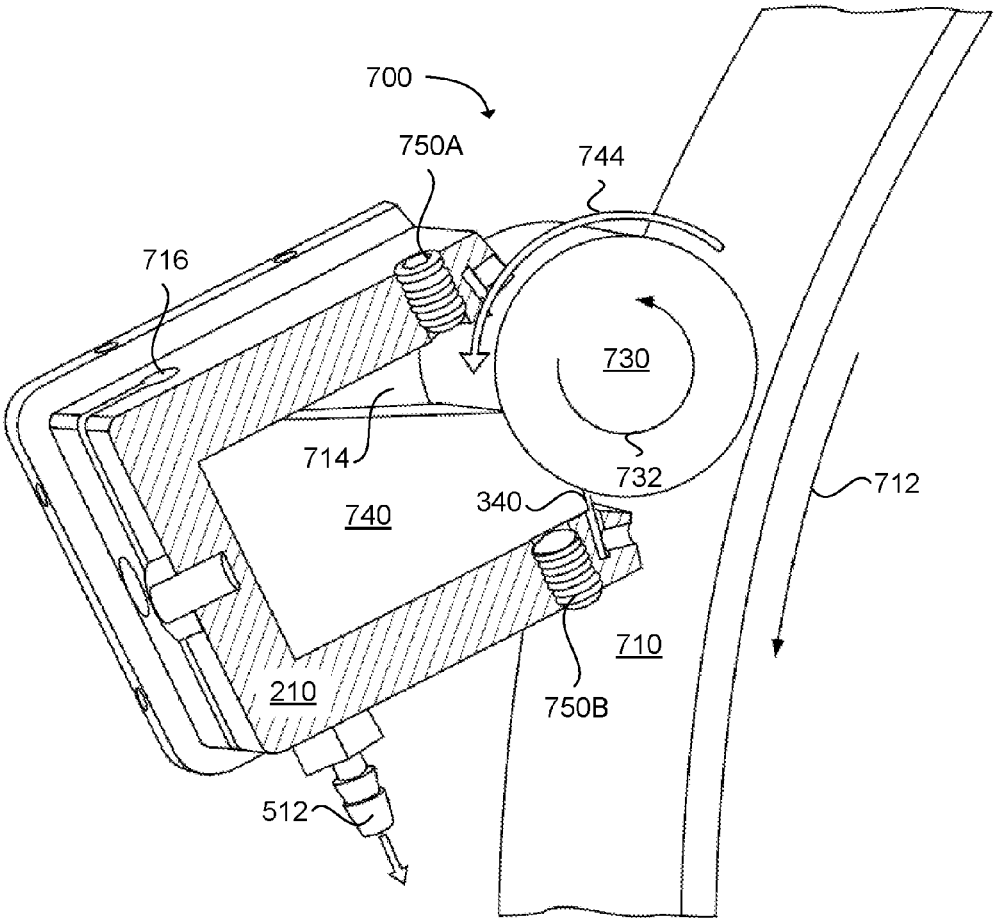
FIG. 10 is an illustrative diagram of an imaging drum with a reverse roller including a fluid container in accordance with an example.

Greater detail of the roller unit in a reverse mode and a forward mode is provided. In the reverse roller mode, the fluid container 210 of the reverse roller unit 700 can be used with a collection reservoir 714 for a carrier fluid 740, as illustrated in FIG. 10. The removed fluid 744 can be returned through a top opening which can operate without a blade when the reverse roller 730 rotates in a same direction 732 (counterclockwise direction in FIG. 10) as a rotation 712 of an imaging drum 710. When the reverse roller has the same rotation as the imaging drum, the reverse roller surface moves in an opposite direction as the imaging drum surface. The lower blade can seal the carrier fluid within the collection reservoir, while an overflow channel including an overflow hole 716 within the fluid container that can allow for excess fluid to be gravity drained from the fluid container. An excess carrier fluid from the overflow channel may flow into a fluid overflow drain 512 (also shown in FIGS. 8 and 9) coupled to the fluid container for draining and/or recycling the carrier fluid. A pump (not shown) may pump the fluid back into the fluid reservoir. The carrier fluid may be filtered and recycled or eliminated into another container. The adjustable fluid container angle allows fluid removal at different angular location without leaks. The fluid container may include container plugs 750A and 750B for filling or removing fluid from the container. The container plugs may be removed or inserted based on the position of the fluid container and the direction of gravity.

Figure 11:
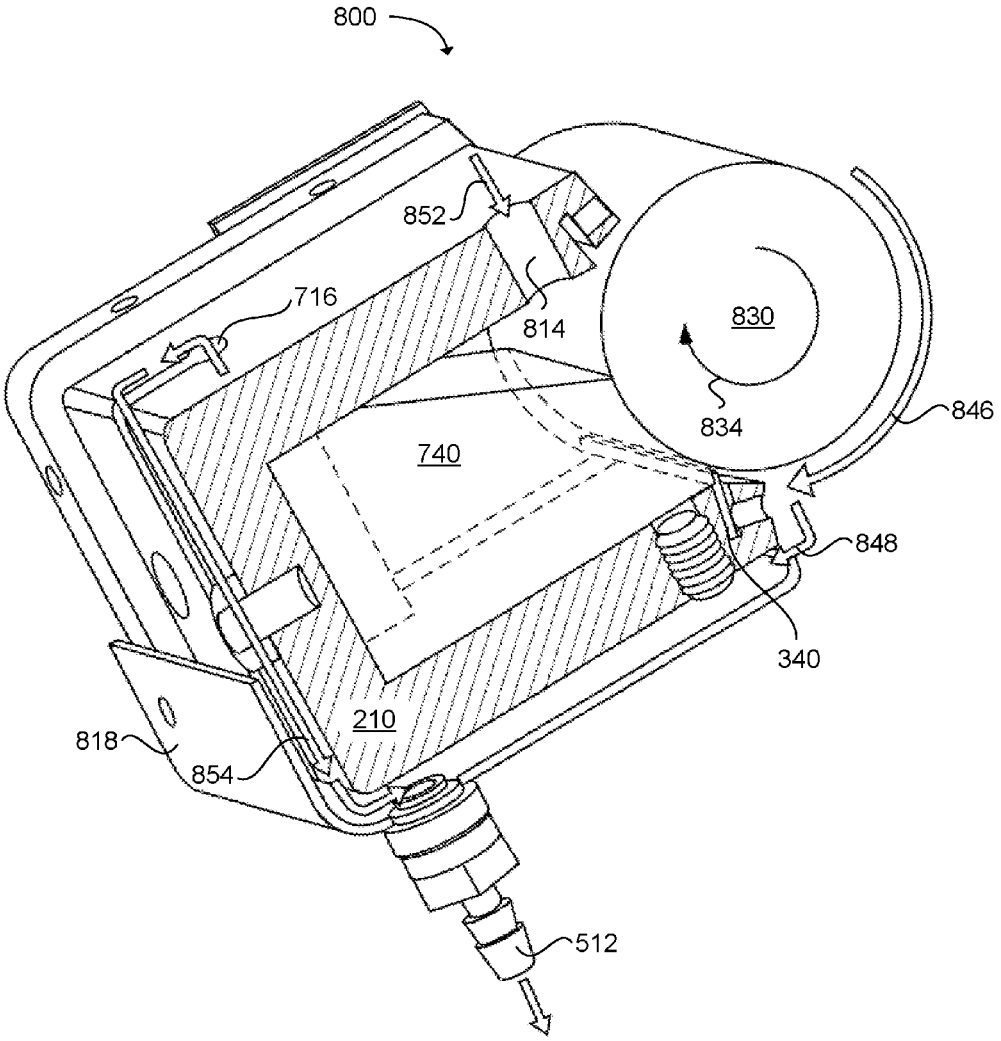
FIG. 11 is an illustrative diagram of an imaging drum with a forward roller including a fluid container in accordance with an example.

In the forward roller mode, the forward roller 830 of the forward roller unit 800 rotates 834 (clockwise direction in FIG. 11) with an opposite rotation as the imaging drum (not shown), the forward roller surface rotates in direction the same direction as the imaging drum surface, as illustrated in FIG. 11. The roller picks up carrier fluid 740 from the collection reservoir of the fluid container 210 which in the forward roller mode can function as a supply reservoir and can transfer 846 the fluid to the imaging drum surface (not shown). A final fluid thickness on the imaging surface can be determined by the spacing and relative speed at the forward roller/imaging surface nip. As an example, aliphatic fluid can wet a metal forward surface very well due to the high surface energy differential, ensuring good uniformity of the coupling layer.

In the forward roller mode, the blade 340, which seals the carrier fluid in the fluid container, can prevent or impede excess fluid remaining on the forward roller after applying the carrier onto the imaging device. An external container layer (or shell) 818 (implemented as an L-shape in FIG. 11) can be used to channel 848 excess carrier fluid from the blade to the fluid overflow drain 512. The excess carrier fluid can be generated in the forward roller mode due to fluid splitting, which can depend on the roller surface speed relative to the imaging drum surface speed. The fluid overflow drain can recover the excess carrier fluid (e.g., a fluid fraction) not delivered to the imaging drum surface and can recycle, store, or dispose of the excess carrier fluid. The external container shell can create a flow channel around the container. The external container shell can provide a seal with the fluid container to keep the carrier fluid in the overflow channels. The external container shell can guide and/or channel both the non-transferred fluid fraction 848 from the roller as well as overflow 854 from the fluid container back to a reservoir preventing unwanted drips onto the imaging surface. The fluid overflow drain can be part of a fluid return for returning the excess carrier fluid to the reservoir chamber of the fluid container. The fluid container may provide an orifice or hole 814 for filling 852 the fluid reservoir with the carrier fluid. Tubing from a larger reservoir or a fluid recycling pump may be used to provide carrier fluid to the fluid container.

The imaging device can use the same roller unit for a forward roller configuration as is used in the reverse roller configuration. In an example, the spacing at the forward roller may be set to be 150 μm from the imaging drum and the reverse nip gap may be set to 50 μm from the imaging drum to produce an approximately 3 μm uniformly thick fluid layer on the imaging surface at 1 meter/second process speed. The imaging device may be used to achieve a coating layer thinner than 3 μm. A thinner coating layer on the imaging drum can reduce or eliminate the energy and/or time for drying or evaporating the carrier fluid. The spacing of the roller from the imaging drum may be larger than the fluid layer thickness. The fluid layer thickness may be altered by the roller and/or imaging drum rotation speed.

Figure 12:
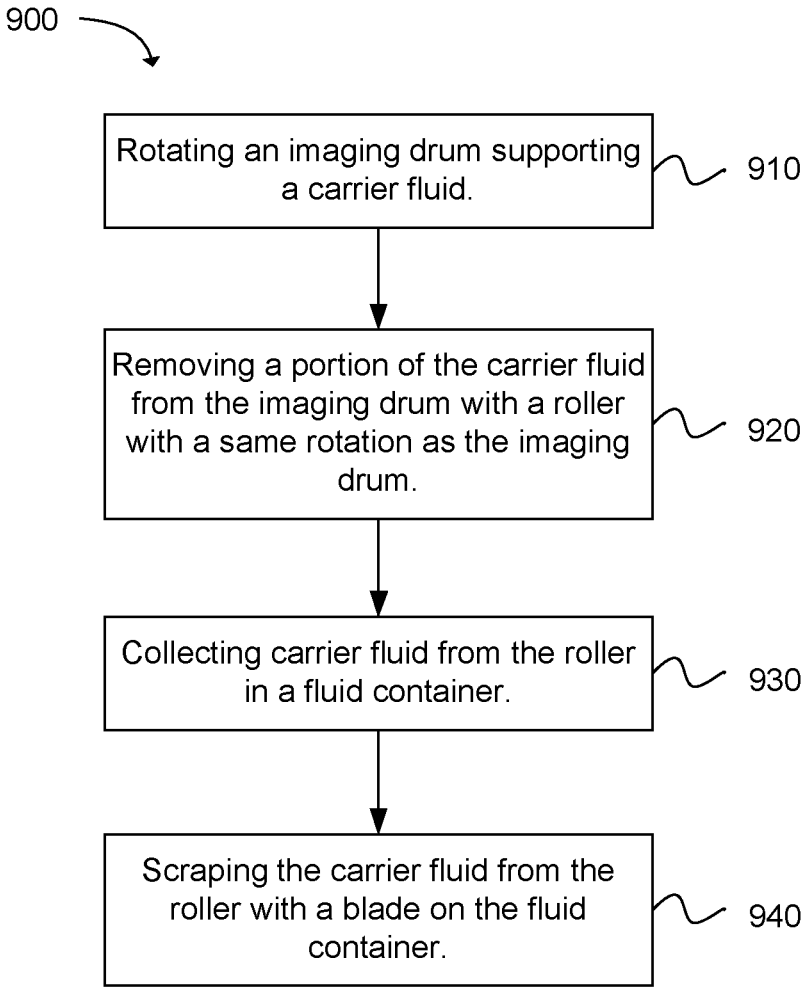
FIG. 12 is a flowchart illustrating a method for collecting a carrier fluid from an imaging drum in accordance with an example.

The use of the reverse roller with an attached closed container can enable efficient "cold removal" at minimal interference with latent images on imaging surface. Cold removal of an ink carrier (a fluid carrier with a marking agent) can make imaging and printing more energy efficient and environmentally friendly compared to other existing platforms. Both the FR-based fluid applicator and the RR-based removal offer excellent controllability and/or synchronization of the fluid coating and removing processes. Fluid container can be used to reduce and prevent overflow and leaks. Fluid flow can be guided in confined channels without interfering with other stations around the imaging drum. The device can be mounted at multiple angular positions without leaks and at multiple locations around the imaging drum for added system flexibility in placing applicators and removal Another example provides a method 900 for collecting a carrier fluid from an imaging drum, as shown in the flow chart in FIG. 12. The method includes the operation of rotating an imaging drum supporting a carrier fluid, as in block 910. The operation of removing a portion of the carrier fluid from the imaging drum with a roller with a same rotation as the imaging drum follows, as in block 920. The next operation of the method may be collecting carrier fluid from the roller in a fluid container, as in block 930. The method further includes scraping the carrier fluid from the roller with a blade on the fluid container, as in block 940.

Additionally, the method for collecting a carrier fluid from an imaging drum may include various other steps. The carrier fluid can be channeled on the roller between a first fluid seal and a second fluid seal. The first fluid seal and the second fluid seal can be attached to the fluid container and conform to the curvature of the roller. An excess carrier fluid can be drained in a reservoir chamber of the fluid container with an overflow channel. The fluid container can be guided against the roller with a guide on a roller frame. The roller frame can couple the roller to the fluid container. The fluid container can be pressed against the roller with a resilient member coupled to a roller frame for applying a force on the fluid container. The roller frame can couple the roller to the fluid container.

Figure 13:
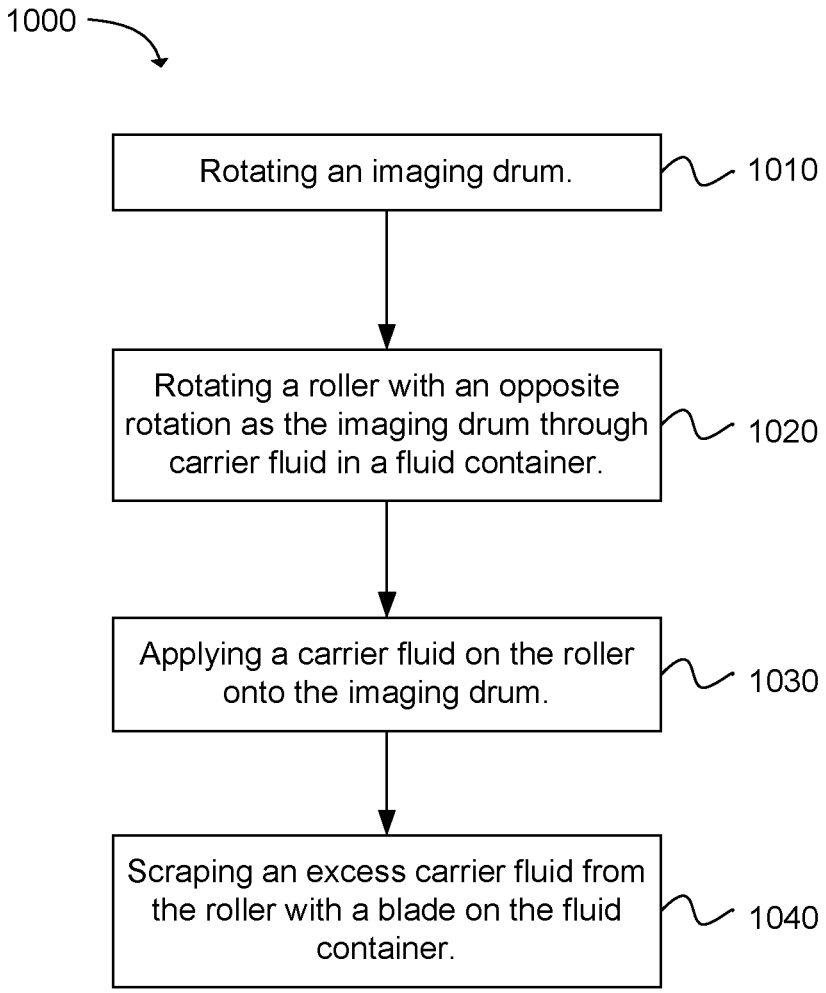
FIG. 13 is a flowchart illustrating a method for applying a carrier fluid onto an imaging drum in accordance with an example.

Another example provides a method 1000 for applying a carrier fluid onto an imaging drum, as shown in the flow chart in FIG. 13. The method includes the operation of rotating an imaging drum, as in block 1010. The operation of rotating a roller with an opposite rotation as the imaging drum through carrier fluid in a fluid container follows, as in block 1020. The next operation of the method may be applying a carrier fluid on the roller onto the imaging drum, as in block 1030. The method further includes scraping an excess carrier fluid from the roller with a blade on the fluid container, as in block 1040.

Additionally, the method for applying a carrier fluid onto an imaging drum may include collecting the excess carrier fluid in an overflow channel of the fluid container and/or returning the excess carrier fluid to a reservoir chamber of the fluid container.

While the forgoing examples are illustrative of the principles of the present disclosure in one or more particular applications, it will be apparent to those of ordinary skill in the art that numerous modifications in form, usage and details of implementation can be made without the exercise of inventive faculty, and without departing from the principles and concepts described. Accordingly, it is not intended that the invention be limited, except as by the claims set forth below.

What is claimed is:

1. An imaging device comprising:

an imaging drum to support a carrier fluid;

a roller to apply the carrier fluid to the imaging drum;

a fluid container to replenish the carrier fluid used by the roller;

a fluid remover on the fluid container for removing an excess carrier fluid from the roller;

a roller frame coupling the roller to the fluid container;

a resilient member coupled to the roller frame for applying a force to press the fluid container against the roller, and an image head to electrically charge portions of the carrier fluid applied to the imaging drum.

2. The imaging device of claim 1, wherein the roller applies the carrier fluid when the roller and imaging drum have opposite rotational directions.

3. The imaging device of claim 1, wherein the roller applies the carrier fluid when the roller and imaging drum have the same rotational directions.

4. The imaging device of claim 1, wherein a roller surface is spaced a predetermined distance from an imaging drum surface with a spacer wheel.

5. The imaging device of claim 1, further comprising:

a first fluid seal attached to the fluid container; and a second fluid seal attached to the fluid container, wherein the first fluid seal and the second fluid seal are sliding seals against a roller cylindrical surface.

6. The imaging device of claim 1, further comprising a fluid container shell on the fluid container for collecting the excess carrier fluid.

7. The imaging device of claim 1, further comprising a fluid return for returning the excess carrier fluid to a reservoir chamber of the fluid container.

8. The imaging device of claim 1, further comprising a motor coupled to the roller for rotating the roller.

9. The imaging device of claim 8, wherein the motor is coupled to the roller by a motor frame, and further comprising a motor frame resilient member to apply a force to press the motor frame against the imaging drum.

* * * * *